US010957273B2

(12) United States Patent
Tomie et al.

(10) Patent No.: US 10,957,273 B2
(45) Date of Patent: Mar. 23, 2021

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventors: Akihiro Tomie, Okaya (JP); Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/689,318

(22) Filed: Nov. 20, 2019

(65) Prior Publication Data

US 2020/0160807 A1 May 21, 2020

(30) Foreign Application Priority Data

Nov. 21, 2018 (JP) ..... JP2018-217900

(51) Int. Cl.
*G09G 3/36* (2006.01)

(52) U.S. Cl.
CPC ..... *G09G 3/3688* (2013.01); *G09G 3/3614* (2013.01); *G09G 3/3677* (2013.01); *G09G 2310/027* (2013.01); *G09G 2310/0251* (2013.01); *G09G 2310/0291* (2013.01); *G09G 2310/0297* (2013.01)

(58) Field of Classification Search
CPC ..... G09G 2310/0291; G09G 3/3208; G09G 2310/0251; G09G 2310/0297; G09G 3/3688; G09G 3/20; G09G 2310/027; G09G 3/3614; G09G 3/3677
See application file for complete search history.

(56) References Cited

U.S. PATENT DOCUMENTS

2005/0169075 A1 8/2005 Park
2008/0100605 A1* 5/2008 Shirai ..... G09G 3/3688 345/206
2009/0179835 A1* 7/2009 Ito ..... G09G 3/34 345/76
2018/0090085 A1 3/2018 Enami

FOREIGN PATENT DOCUMENTS

JP 2018-054877 A 4/2018

* cited by examiner

*Primary Examiner* — Charles V Hicks
(74) *Attorney, Agent, or Firm* — Oliff PLC

(57) ABSTRACT

A display driver includes a processing circuit configured to output display data, a D/A conversion circuit configured to D/A-convert the display data output from the processing circuit, a data voltage output terminal, and an amplifier circuit configured to output a data voltage to the data voltage output terminal on the basis of a D/A conversion result output from the D/A conversion circuit. In a pre-charge period, the processing circuit outputs first pre-charge data as pre-charge data for a D/A conversion circuit DACi, and outputs second pre-charge data different from the first pre-charge data as pre-charge data for a D/A conversion circuit DACj.

9 Claims, 14 Drawing Sheets

| TD | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| DISPLAY DATA OF IMMEDIATELY PRECEDING LINE | 5 | 5 | 5 | 5 | 5 | 5 | 5 | 5 | 5 | 5 | 5 | 5 | 5 | 5 | 5 | 5 | 5 | 5 | 5 | 5 |
| OFFSET | 3 | 3 | 3 | 3 | 3 | 3 | 3 | 3 | 3 | 3 | 3 | 3 | 3 | 3 | 3 | 3 | 3 | 3 | 3 | 3 |
| CORRECTION COEFFICIENT | 5.5 | 6.1 | 6.5 | 7.0 | 7.3 | 7.6 | 7.9 | 8.1 | 8.2 | 8.2 | 8.2 | 8.2 | 8.1 | 7.9 | 7.6 | 7.3 | 7.0 | 6.5 | 6.1 | 5.5 |
| ERROR ESTIMATION VALUE | 44.1 | 48.5 | 52.4 | 55.8 | 58.7 | 61.1 | 63.0 | 64.5 | 65.5 | 65.9 | 65.9 | 65.5 | 64.5 | 63.0 | 61.1 | 58.7 | 55.8 | 52.4 | 48.5 | 44.1 |
| CAPABILITY CORRECTION VALUE | 0.0 | 0.0 | 0.0 | 0.0 | 0.0 | 1.1 | 3.0 | 4.5 | 5.5 | 5.9 | 5.9 | 5.5 | 4.5 | 3.0 | 1.1 | 0.0 | 0.0 | 0.0 | 0.0 | 0.0 |

FIG. 11

DISPLAY DRIVER, ELECTRO-OPTICAL DEVICE, AND ELECTRONIC APPARATUS

The present application is based on, and claims priority from JP Application Serial Number 2018-217900, filed Nov. 21, 2018, the disclosure of which is hereby incorporated by reference herein in its entirety.

BACKGROUND

1. Technical Field

The present disclosure relates to a display driver, an electro-optical device, and an electronic apparatus.

2. Related Art

A pre-charge technique is known in which a predetermined pre-charge voltage is applied to a data line before writing a data voltage into a pixel in a display driver that drives an electro-optical panel. For example, a method in which charge leakage from pixels is equalized by means of pre-charging to improve the image quality is known. A technique related to pre-charging is disclosed in Japanese Unexamined Patent Application Publication No. 2018-54877, for example. In Japanese Unexamined Patent Application Publication No. 2018-54877, a data line driving circuit that outputs an image signal to a data line in a gradation display period outputs a pre-charge voltage to a data lines in a pre-charge period preceding the gradation display period.

In recent years, with the increasing number of pixels in an electro-optical panel, the numbers of D/A conversion circuits and amplifier circuits arranged along the long side direction of the display driver have also been increasing. In addition, due to the increase in the number of pixels or the display frame rate of an electro-optical panel, ensuring a sufficient pre-charge period has become increasingly difficult. As such, as the number of D/A conversion circuits and amplifier circuits of the display driver increases, the supply capability of the pre-charge voltage at the end portion in the long side direction and the supply capability of the pre-charge voltage at the center portion in the long side direction may become disadvantageously non-uniform under the influence of the parasitic resistance or parasitic capacitance of wiring lines.

SUMMARY

An aspect of the present disclosure relates to a display driver including a processing circuit configured to output display data, first to nth D/A conversion circuits (n is an integer of 3 or greater) configured to D/A-convert the display data output from the processing circuit, and to output a D/A conversion result, first to nth data voltage output terminals, and first to nth amplifier circuits configured to output first to nth data voltages to the first to nth data voltage output terminals based on the D/A conversion result output from the first to nth D/A conversion circuits. In a pre-charge period, the processing circuit outputs pre-charge data, the first to nth D/A conversion circuits D/A-convert the pre-charge data, and the first to nth amplifier circuits output a pre-charge voltage based on an output voltage of the first to nth D/A conversion circuits, and the processing circuit, in the pre-charge period, outputs first pre-charge data as the pre-charge data for an ith D/A conversion circuit, and outputs second pre-charge data as the pre-charge data for a jth D/A conversion circuit, the second pre-charge data being different from the first pre-charge data, i being an integer not smaller than 1 and not greater than n, j being an integer that is not equal to i and is not smaller than 1 and not greater than n.

BRIEF DESCRIPTION OF THE DRAWINGS

FIG. 11 illustrates exemplary computation of pre-charge data.

DESCRIPTION OF EXEMPLARY EMBODIMENTS

A preferable embodiment of the present disclosure will be described in detail hereinafter. Note that the embodiment described hereinafter is not intended to unjustly limit the content of the present disclosure as set forth in the claims, and all of the configurations described in the embodiments are not always required to solve the issues described in the present disclosure.

1. Display Driver

Figure 1:
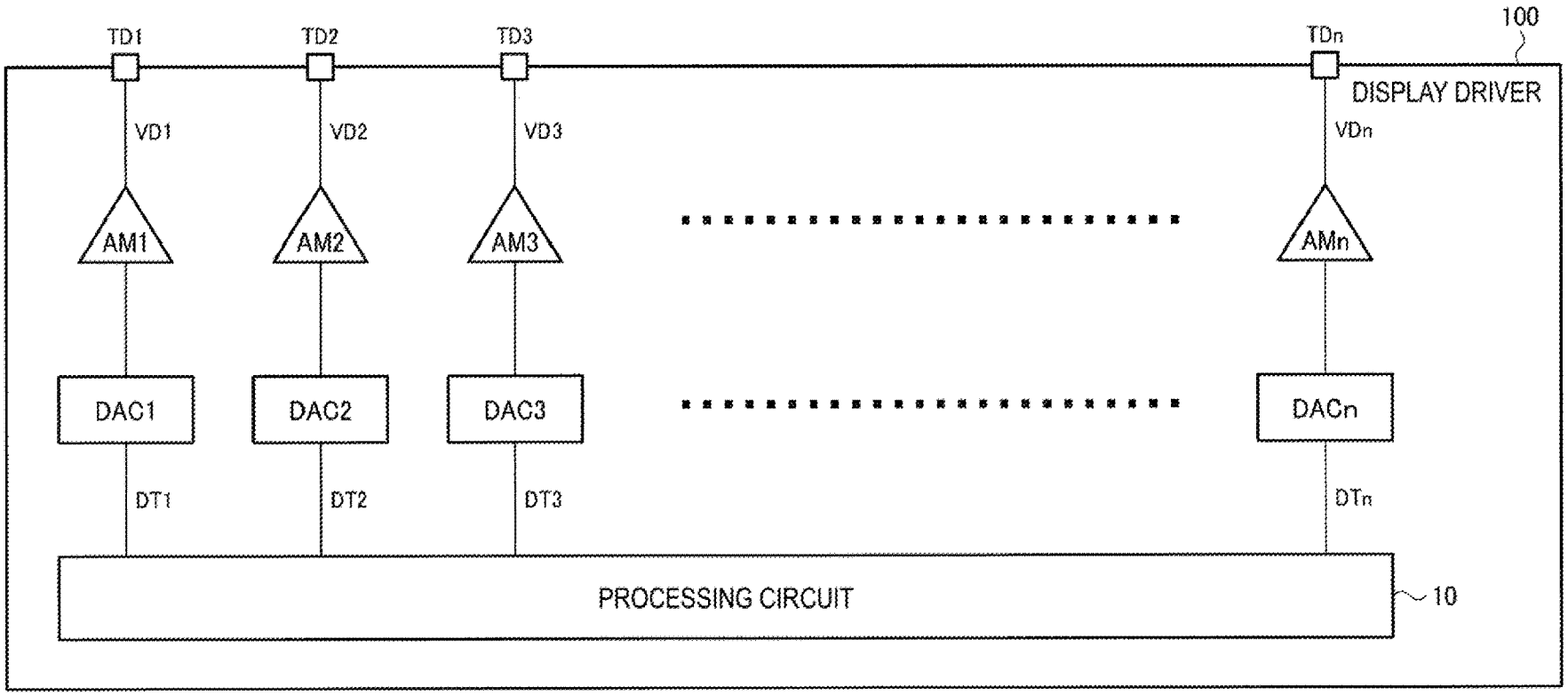
FIG. 1 illustrates an exemplary configuration of a display driver.

FIG. 1 illustrates an exemplary configuration of a display driver 100. The display driver 100 illustrated in FIG. 1 drives an electro-optical panel by supplying a data voltage to pixels of the electro-optical panel. For example, a liquid crystal display panel of an active matrix type can be assumed as the electro-optical panel. The display driver 100 is an integrated circuit device.

The display driver 100 includes data voltage output terminals TD1 to TDn serving as first to nth data voltage output terminals, amplifier circuits AM1 to AMn serving as first to nth amplifier circuits, D/A conversion circuits DAC1 to DACn serving as first to nth D/A conversion circuits, and a processing circuit 10. Note that n is an integer of 3 or greater.

The processing circuit 10 outputs data DT1 to the D/A conversion circuit DAC1. Likewise, the processing circuit 10 outputs data DT2 to DTn to the D/A conversion circuits DAC2 to DACn. The data DT1 to DTn is display data in a pixel driving period, and is pre-charge data in a pre-charge period preceding the pixel driving period. In addition, the processing circuit 10 controls each unit of the display driver 100. For example, the processing circuit 10 performs a timing control when the display driver 100 drives the electro-optical panel. The processing circuit 10 is a logic circuit. The logic circuit includes logic elements and signal lines connecting between the logic elements, and the function of the logic circuit is achieved by the logic elements and the signal lines. Alternatively, the processing circuit 10 may be a processor such as a digital signal processor (DSP). In this case, the function of the processing circuit 10 is achieved when the processor executes a program in which the function of the processing circuit 10 is described.

The D/A conversion circuit DAC1 D/A-converts the data DT1 to a voltage corresponding to the data DT1. Specifically, the D/A conversion circuit DAC1 selects a gradation voltage corresponding to the data DT1 from among a plurality of gradation voltages. Likewise, the D/A conversion circuits DAC2 to DACn D/A-convert the data DT2 to DTn to voltages corresponding to the data DT2 to DTn. Each of the D/A conversion circuits DAC1 to DACn is a selector composed of a transistor switch, for example.

The amplifier circuit AM1 amplifies or buffers the voltage output from the D/A conversion circuit DAC1, and outputs the result to the data voltage output terminal TD1 as a voltage VD1. Likewise, the amplifier circuits AM2 to AMn amplify or buffer voltages output from the D/A conversion circuits DAC2 to DACn, and output the results to the data voltage output terminals TD2 to TDn as voltages VD2 to VDn. The voltages VD1 to VDn are data voltages in the pixel driving period and are pre-charge voltages in the pre-charge period preceding the pixel driving period. Each of the amplifier circuits AM1 to AMn includes an operational amplifier. Each of the amplifier circuits AM1 to AMn may include a resistor, a capacitor and the like for configuring a feedback circuit of the operational amplifier and the like. Each of the amplifier circuits AM1 to AMn is a voltage follower circuit, a non-inverting amplifier circuit, an inverting amplifier circuit or the like, for example.

The data voltage output terminals TD1 to TDn are arranged along the long side direction of the display driver 100. The data voltage output terminals TD1 to TDn are pads provided in a semiconductor substrate of an integrated circuit device or terminals provided in a package of an integrated circuit device. The data voltage output terminals TD1 to TDn are connected to the data voltage input terminals of the electro-optical panel through wiring lines on the circuit board, cables or the like.

Figure 2:
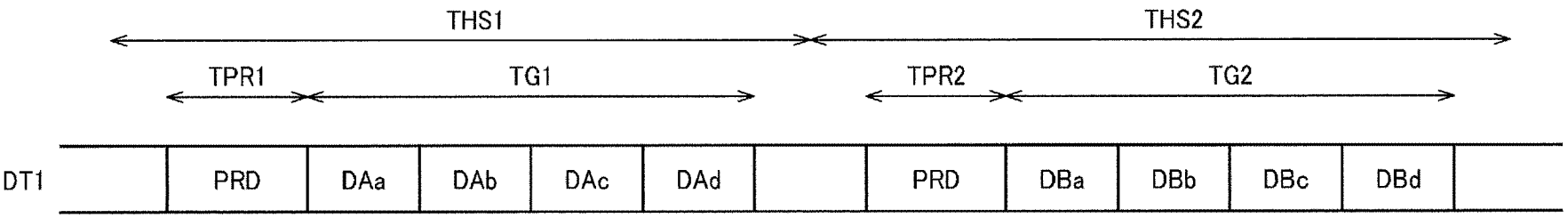
FIG. 2 is a diagram illustrating an operation of the display driver.
Figure 15:
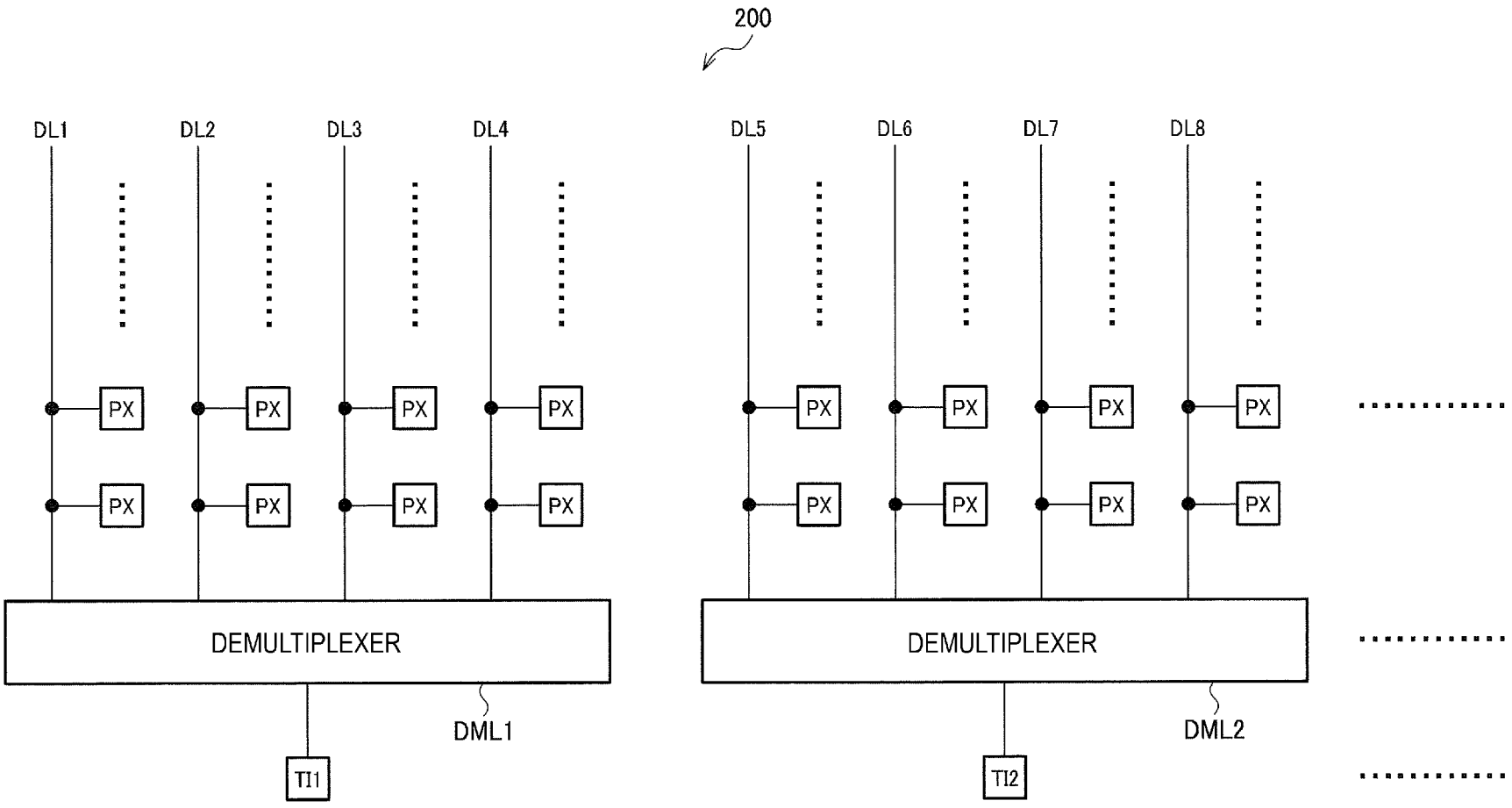
FIG. 15 illustrates an exemplary configuration of an electro-optical panel.

FIG. 2 is a diagram illustrating an operation of the display driver 100. FIG. 15 illustrates an exemplary configuration of an electro-optical panel 200 that is driven by the display driver 10. The electro-optical panel 200 includes data voltage input terminals TI1 and TI2, demultiplexers DML1 and DML2, data lines DL1 to DL8, and a plurality of pixels PX. Although FIG. 15 illustrates only portions connected with the data voltage input terminals TI1 and TI2, the same configuration is provided also in the data voltage input terminal TI3 and succeeding terminals. While the following describes an exemplary operation of the display driver 100 with the data DT1, the operation of the display driver 100 is identical for the data DT2 to DTn. In addition, while the following describes an exemplary case where the display driver 100 performs a demultiplex driving in which the multiplexing number is four, it suffices that the number of multiplexing is two or more.

The processing circuit 10 outputs pre-charge data PRD in a pre-charge period TPR1 of a horizontal scanning period THS1. As a result, a pre-charge voltage is output from the amplifier circuit AM1, and a data line of the electro-optical panel 200 is pre-charged. Next, the processing circuit 10 sequentially outputs display data DAa, DAb DAc and DAd in a pixel driving period TG1 of the horizontal scanning period THS1. As a result, data voltages corresponding to the display data DAa, DAb, DAc, and DAd are sequentially output from the amplifier circuit AM1. Likewise, the processing circuit 10 outputs pre-charge data PRD in a pre-charge period TPR2 of a horizontal scanning period THS2, and sequentially outputs display data DBa, DBb, DBc and DBd in a pixel driving period TG2 of the horizontal scanning period THS2.

The data voltage output terminal TD1 is connected to the data voltage input terminal TI1 of the electro-optical panel 200. The data voltage input terminal TI1 is connected to the first to fourth data lines DL1 to DL4 through the demultiplexer DML1. The first to fourth data lines DL1 to DL4 are data lines continuously arranged in the horizontal scanning direction in the electro-optical panel 200. Pixels PX are connected to each data line. In the pre-charge period TPR1, the demultiplexer DML1 connects the data voltage input terminal TI1 and all of the first to fourth data lines DL1 to DL4. In other words, all of the first to fourth data lines DL1 to DL4 are pre-charged with a pre-charge voltage. In the pixel driving period TG1, the demultiplexer DML1 sequentially selects the first to fourth data lines DL1 to DL4 and connects the lines to the data voltage input terminal TI1. In other words, the first data line DL1 is driven with a data voltage corresponding to the display data DAa. Likewise, the second to fourth data lines DL2 to DL4 are driven with data voltages corresponding to the display data DAb, DAc and DAd. Operations similar to the above-mentioned operations are performed in the pre-charge period TPR2 and the pixel driving period TG2. Note that the driving order of the first to fourth data lines DL1 to DL4 in the pixel driving period is not limited to the above-described order, and may be any order.

In the present embodiment, the display driver 100 performs frame inversion driving. Frame inversion driving is a driving method in which the polarity of a data voltage is inverted on a single-frame basis or on a multiple-frame basis The frame is a vertical scanning period. The display data DAa to DAd and DBa to DBd are display data representing positive data voltages in a positive polarity driving frame, and are data representing negative data voltages in a negative polarity driving frame. On the other hand, the pre-charge data PRD is data representing a negative pre-charge voltage in both the positive polarity driving frame and the negative polarity driving frame. Here, the positive voltage is a voltage higher than the common voltage, and a negative voltage is a voltage lower than the common voltage. Note that the pre-charge technique of the present embodiment may be applied not only to frame inversion driving, but also to line inversion driving and the like. Line inversion driving is a driving technique in which the polarity of a data voltage is inverted on a single-scan line basis or on a multiple-scan line basis.

While a case where pre-charging is performed on a single-line basis is described in FIG. 2, pre-charging may be performed on a multiple-line basis.

Figure 3:
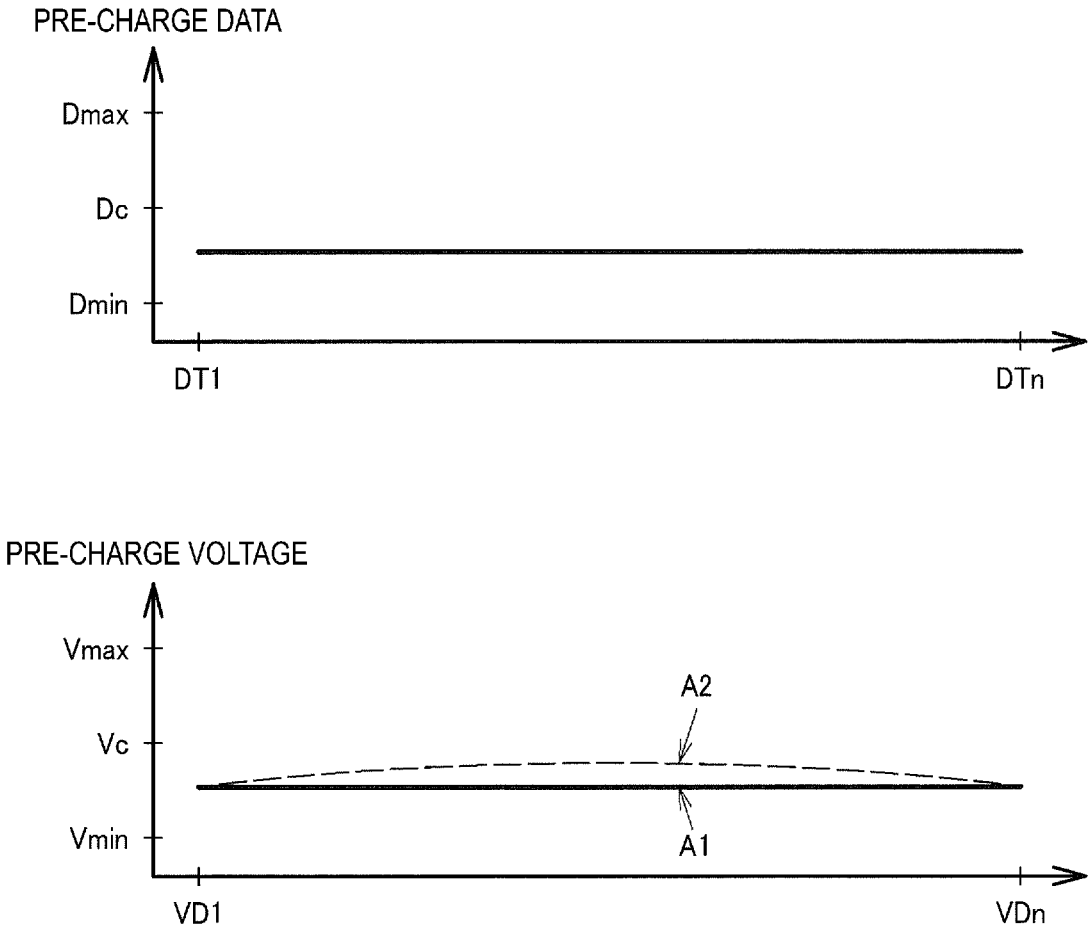
FIG. 3 illustrates a comparative example of a pre-charge technique.

FIG. 3 illustrates a comparative example of a pre-charge technique. Dmax is data corresponding to a positive maximum gradation, Dc is data corresponding to a common voltage, and Dmin is data corresponding to a negative maximum gradation. Vmax is a voltage corresponding to a positive maximum gradation, Vc is a common voltage, and Vmin is a voltage corresponding to a negative maximum gradation.

In the comparative example, all the pre-charge data output as data DT1 to DTn is identical data. Accordingly, as A1 indicates in FIG. 3, all the pre-charge voltages output as the voltages VD1 to VDn are identical voltages.

However, the capabilities of outputting the pre-charge voltage of the amplifier circuits AM1 to AMn differ depending on the positions in the long side direction of the display driver 100. Consequently, as A2 indicates, the pre-charge voltages actually supplied to the data lines vary depending on the positions in the long side direction. Specifically, the pre-charge voltage at the center portion in the long side direction is higher than the pre-charge voltage near the end portion in the long side direction. This is due to a parasitic resistance or parasitic capacitance of the wiring line along the long side direction. For example, a power source line that supplies low electric potential side power to the amplifier circuits AM1 to AMn is laid along the long side direction. When the amplifier circuits AM1 to AMn output a pre-charge voltage, the voltage of the power source line increases under the influence of a parasitic resistance. This voltage increase is greater in the center portion in the long side direction than in the end portion in the long side direction. As a result, the capability of outputting the negative pre-charge voltage decreases in the center portion in the long side direction, and consequently the pre-charge voltage in the center portion in the long side direction becomes higher than an ideal value.

The following describes a pre-charge technique according to the present embodiment, which can solve the above-described problems.

2. First Embodiment

Figure 4:
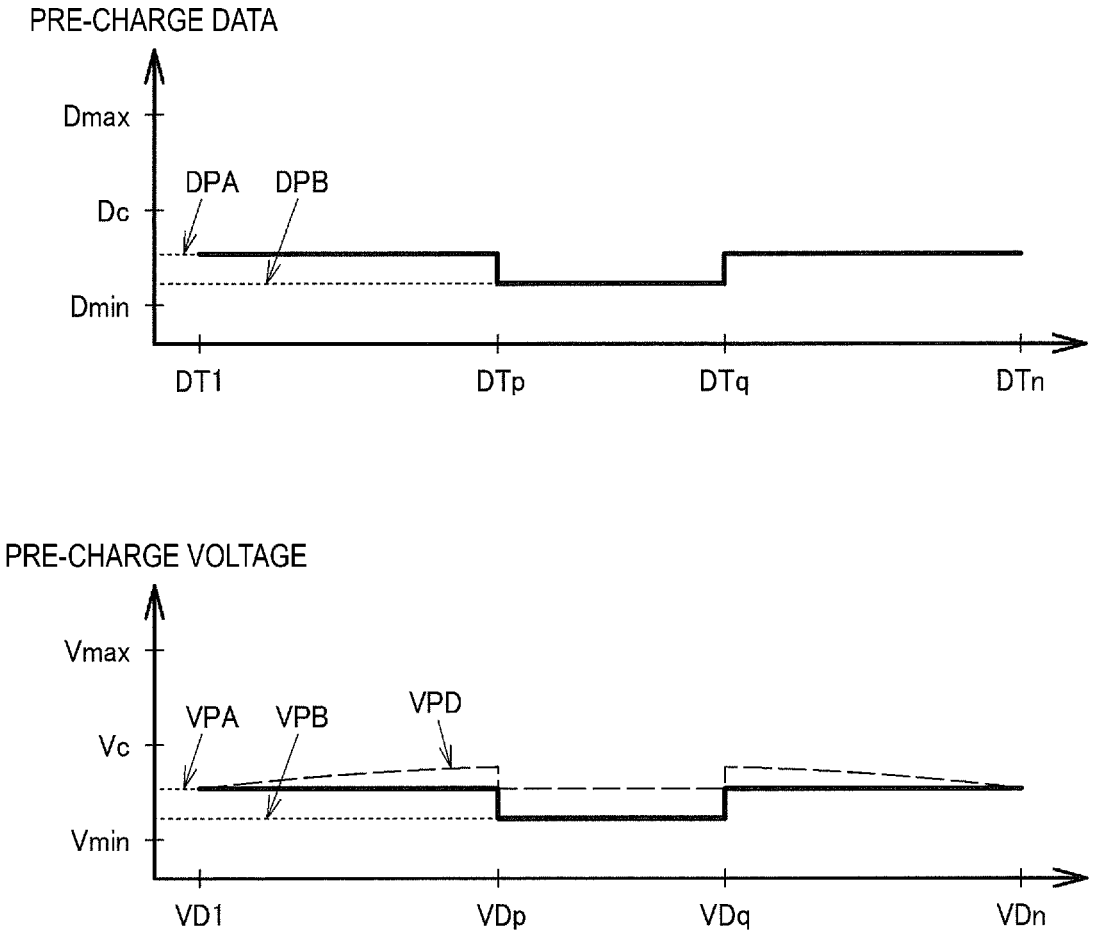
FIG. 4 is a diagram illustrating a pre-charge technique according to a first embodiment.

FIG. 4 is a diagram illustrating a pre-charge technique according to a first embodiment. Note that, while an exemplary case where the lower the pre-charge voltage, the lower the value of the corresponding pre-charge data is described, it is also possible to adopt a configuration in which the lower the pre-charge voltage, the greater the value of the corresponding pre-charge data.

In the first embodiment, the processing circuit 10 outputs pre-charge data DPA as data DT1 to DTp−1 and data DTq+1 to DTn, and outputs pre-charge data DPB as data DTp to DTq. The pre-charge data DPB corresponds to a gradation value lower than the pre-charge data DPA. The p and q are integers from 2 to n−1. The p and q are set such that the data voltage output terminals TDp to TDq are at or near the center in the long side direction of the display driver 100. For example, the p and q are set so as to be symmetrical at the center in the long side direction of the display driver 100. In this case, the number of data voltage output terminals TD1 to TDp−1 and the number of data voltage output terminals TDq+1 to TDn are equal to each other.

As a result of the output of the above-described pre-charge data, the pre-charge voltage VPA is output as the voltages VD1 to VDp−1 and the voltages VDq+1 to VDn, and the pre-charge voltage VPB is output as the voltages VDp to VDq. VPB<VPA holds. In other words, the pre-charge voltage VPB at or near the center portion in the long side direction of the display driver 100 is lower than the pre-charge voltage VPA at or near the end portion. The pre-charge voltage indicated by the solid line in FIG. 4 has an ideal value. In other words, the pre-charge voltage actually supplied to the data line is higher than the ideal value in the center portion in the long side direction, and as such is represented as the VPD indicated by the long-dotted line in FIG. 4. As a result, a voltage close to the VPA is output as the voltages VDp to VDq. Since the VPA is supplied to the data line at the end portion in the long side direction, the difference in the pre-charge voltage between the end portion and the center portion in the long side direction becomes small.

Figure 5:
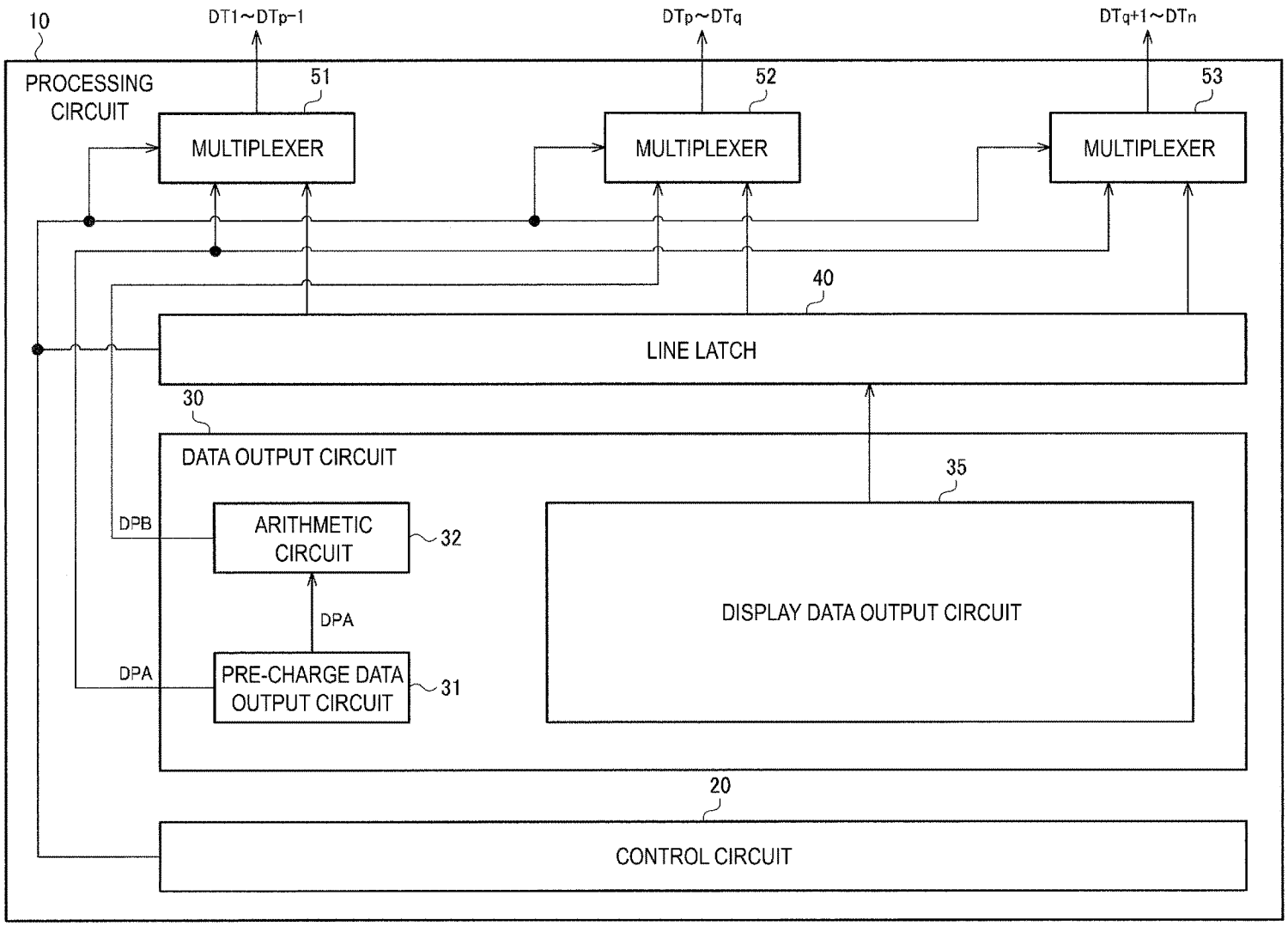
FIG. 5 illustrates a first exemplary detailed configuration of an arithmetic circuit.

FIG. 5 illustrates a first exemplary detailed configuration of the processing circuit 10. The processing circuit 10 includes a control circuit 20, a data output circuit 30, a line latch 40, and multiplexers 51 to 53.

The control circuit 20 controls the data output circuit 30, the line latch 40, and the multiplexers 51 to 53. Specifically, the control circuit 20 controls the latch timing of the line latch 40. The control circuit 20 also controls data selection operations of the multiplexers 51 to 53.

The data output circuit 30 outputs pre-charge data and display data. The data output circuit 30 includes a pre-charge data output circuit 31, an arithmetic circuit 32, and a display data output circuit 35. The pre-charge data output circuit 31 outputs the pre-charge data DPA to the multiplexers 51 and 53 and the arithmetic circuit 32. The arithmetic circuit 32 determines the pre-charge data DPB by performing a computation on the pre-charge data DPA. Specifically, the arithmetic circuit 32 determines the pre-charge data DPB by subtracting a correction value from the pre-charge data DPA. In the first embodiment, the correction value is a constant. Note that the arithmetic circuit 32 may determine the pre-charge data DPB by DPB=DPA−(correction value×coefficient). The coefficient may be any real number. The arithmetic circuit 32 outputs the pre-charge data DPB to the multiplexer 52. The display data output circuit 35 outputs the display data to the line latch 40.

The line latch 40 outputs time-division multiplexed display data to the multiplexers 51 to 53 in the pixel driving period.

In the pre-charge period, the multiplexers 51 and 53 output the pre-charge data DPA as data DT1 to DTp−1 and DTq+1 to DTn, and the multiplexer 53 outputs the pre-charge data DPB as data DTp to DTq. In the pixel driving period, the multiplexers 51 to 53 output the display data from the line latch 40 as data DT1 to DTn.

According to the present embodiment, the processing circuit 10 outputs first pre-charge data to a D/A conversion circuit DACi in the pre-charge period, and outputs second pre-charge data different from the first pre-charge data to a D/A conversion circuit DACj. The i is an integer of 1 or greater and n or smaller, and the j is an integer that satisfies $j \neq i$ and is 1 or greater and n or smaller. Specifically, $1 \leq i \leq p-1$ or $q+1 \leq i \leq n$, and $p \leq j \leq q$ hold. In the first embodiment, the first pre-charge data is DPA and the second pre-charge data is DPB.

In this manner, the difference between the supply capability of the pre-charge voltage at the end portion in the long side direction of the display driver 100 and the supply capability of the pre-charge voltage at the center portion in the long side direction can be reduced. In other words, as described in the comparative example of FIG. 3, while the actual pre-charge voltage increases to a value greater than the ideal pre-charge voltage in the center portion in the long side direction, the present embodiment can set the pre-charge data that differs between the end portion and the center portion in the long side direction. It is thus possible to reduce the difference in the pre-charge voltage actually supplied to the data lines between the end portion and the center portion in the long side direction.

For example, charge leakage from the pixels is equalized by means of pre-charging to improve the image quality. According to the present embodiment, the difference in the pre-charge voltage actually supplied to the data lines between the end portion and the center portion in the long side direction is reduced, and thus the charge leakage can be more equalized. Thus, the image quality can be improved.

In addition, in the present embodiment, the first pre-charge voltage corresponding to the first pre-charge data and the second pre-charge voltage corresponding to the second pre-charge data are pre-charge voltages that are negative with respect to the common voltage. The second pre-charge voltage is lower than the first pre-charge voltage.

In this manner, the second pre-charge voltage at the center portion in the long side direction can be lower than the first pre-charge voltage at the end portion, and it is thus possible to reduce the pre-charge voltage actually supplied to the data lines in the center portion in the long side direction. As a result, the difference in the pre-charge voltage actually supplied to the data lines between the end portion and the center portion in the long side direction is reduced.

3. Second Embodiment

Figure 6:
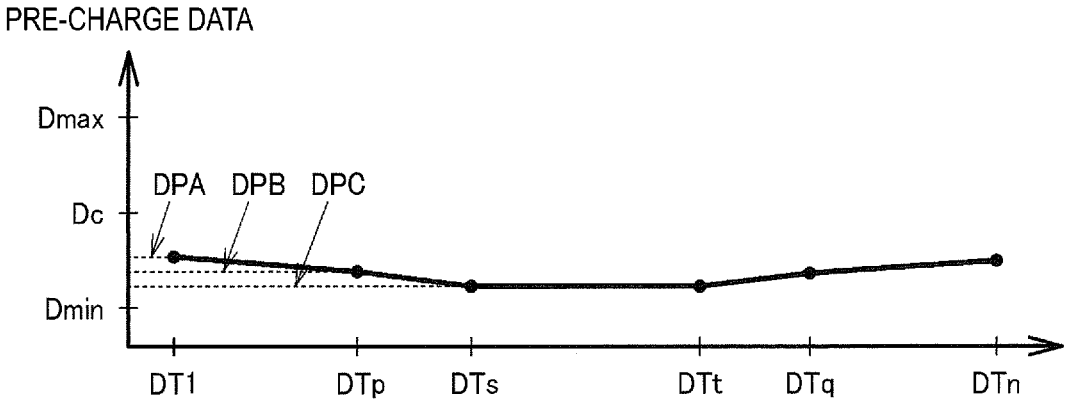
FIG. 6 is a diagram illustrating a pre-charge technique according to a second embodiment.
Figure 6:
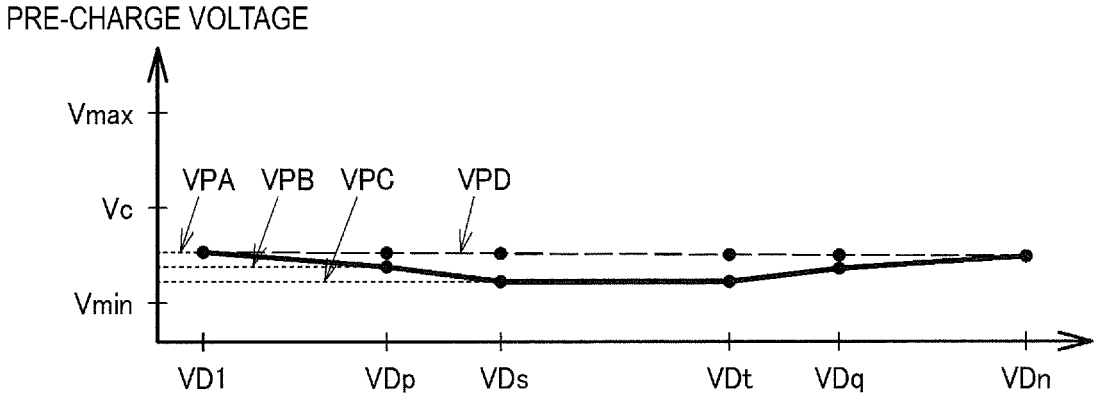

FIG. 6 is a diagram illustrating a pre-charge technique according to a second embodiment.

In the second embodiment, the processing circuit 10 outputs, as data DT1 to DTn, pre-charge data obtained by linear interpolation between correction points. The correction points are p, s, t and q. The s and t are integers of p+1 or greater and q−1 or smaller. Specifically, the processing circuit 10 outputs, as data DT1 to DTp−1, pre-charge data obtained by linear interpolation between DPA and DPB. The processing circuit 10 also outputs, as data DTp to DTs−1, the pre-charge data obtained by linear interpolation between DPB and DPC. The processing circuit 10 also outputs, as data DTs to DTt, the pre-charge data DPC. The processing circuit 10 also outputs, as data DTt+1 to DTq, the pre-charge data obtained by linear interpolation between DPC and DPB. The processing circuit 10 also outputs, as data DTq+1 to DTn, the pre-charge data obtained by linear interpolation between DPB and DPA.

The p, s, t and q are set such that that the data voltage output terminals TDs to TDt are at or near the center in the long side direction of the display driver 100. For example, the p, s, t, and q are set so as to be symmetrical at the center in the long side direction of the display driver 100. In this case, the number of the data voltage output terminals TD1 to TDp−1 and the number of the data voltage output terminals TDq+1 to TDn are equal to each other, and the number of the data voltage output terminals TDp to TDs−1 and the number of the data voltage output terminals TDt+1 to TDq are equal to each other.

As a result of the output of the above-described pre-charge data, the pre-charge voltage obtained by linear interpolation between VDA and VDB is output as voltages VD1 to VDp−1. In addition, the pre-charge voltage obtained by linear interpolation between VDB and VDC is output as voltages VDp to VDs−1. In addition, the pre-charge voltage VPC is output as voltages VDs to VDt. In addition, the pre-charge voltage obtained by linear interpolation between VDC and VDB is output as voltages VDt+1 to VDq. In addition, the pre-charge voltage obtained by linear interpolation between VDB and VDA is output as voltages VDq+1 to VDn. VPC<VPB<VPA holds. In other words, the pre-charge voltage decreases from the end portion toward the center portion in the long side direction of the display driver 100. The pre-charge voltage indicated by the solid line in FIG. 6 has an ideal value. In other words, the pre-charge voltage actually supplied to the data line is higher than the ideal value in the center portion in the long side direction, and as such is represented as the VPD indicated by the long-dotted line in FIG. 6. As a result, a voltage close to the VPA is output as the voltages VD1 to VDn. Since the VPA is supplied to the data line at the end portion in the long side direction, the difference in the pre-charge voltage between the end portion and the center portion in the long side direction becomes small.

Figure 7:
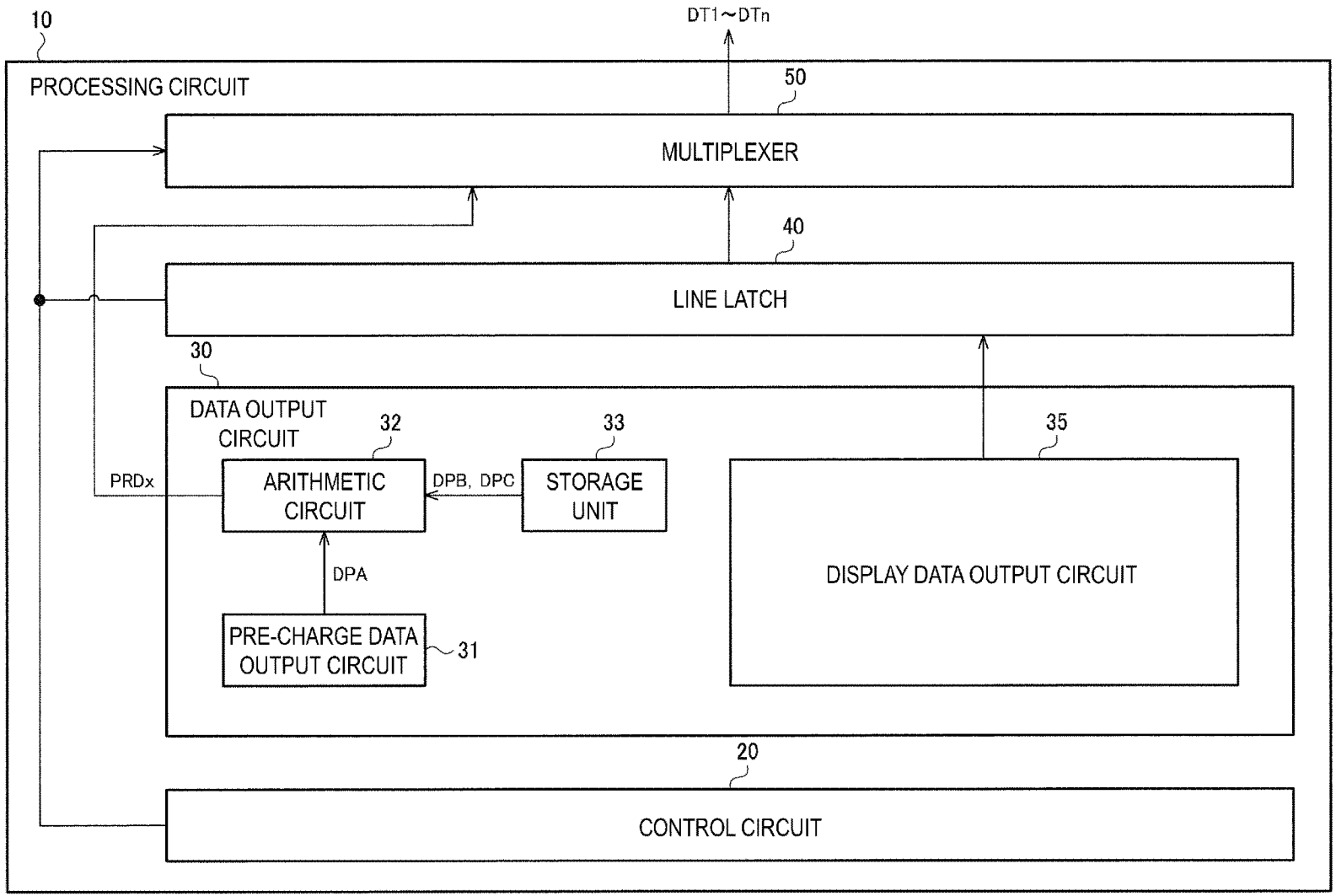
FIG. 7 illustrates a second exemplary detailed configuration of the arithmetic circuit.

FIG. 7 illustrates a second exemplary detailed configuration of the processing circuit 10. The processing circuit 10 includes the control circuit 20, the data output circuit 30, the line latch 40, and a multiplexer 50. The data output circuit 30 includes the pre-charge data output circuit 31, the arithmetic circuit 32, a storage unit 33, and the display data output circuit 35. Note that the same components as the components already described will be denoted with the same reference numerals, and description of such components will be appropriately omitted.

The storage unit 33 stores the pre-charge data DPB and DPC at the correction point. The storage unit 33 may be a semiconductor memory such as a RAM, a ROM and a nonvolatile memory, or may be a register, for example. The pre-charge data DPB and DPC may be stored in advance in the storage unit 33. Alternatively, the display driver 100 may include an interface circuit not illustrated, and an external processing device may write the pre-charge data DPB and DPC into the storage unit 33 via the interface circuit not illustrated.

The arithmetic circuit 32 determines the pre-charge data PRDx on the basis of the pre-charge data DPA from the pre-charge data output circuit 31 and the pre-charge data DPB and DPC from the storage unit 33. The x represents an integer of 1 or greater and n or smaller. Specifically, the arithmetic circuit 32 determines a correction value (x) for the linear interpolation between correction points on the basis of the pre-charge data DPA to DPC, and determines the pre-charge data PRDx by PRDx=DPA−correction value (x). The correction value (x) is a correction value corresponding to PRDx. The PRDx is the pre-charge data described in FIG. 6. Note that the arithmetic circuit 32 may determine the pre-charge data PRDx by PRDx=DPA−(correction value (x)×coefficient). The arithmetic circuit 32 outputs the pre-charge data PRDx to the multiplexer 50. The multiplexer 50 outputs the pre-charge data PRDx as data DTx in the pre-charge period.

According to the present embodiment, in the pre-charge period, the processing circuit 10 outputs the first pre-charge data to the D/A conversion circuit DACi, the second pre-charge data to the D/A conversion circuit DACj, and the third pre-charge data to the D/A conversion circuit DACk. The k is an integer of 1 or greater and n or smaller. The second pre-charge data differs from the first pre-charge data, and the third pre-charge data is different from the first pre-charge data and the second pre-charge data. $1 \le i \le p-1$ or $q+1 \le i \le n$, and $p \le j \le s-1$ or $t+1 \le j \le q$, and, $s \le k \le t$ hold. In the second embodiment, the first pre-charge data is data between DPA and DPB, the second pre-charge data is data between DPB and DPC, and the third pre-charge data is DPC.

In this manner, the difference between the supply capability of the pre-charge voltage at the end portion in the long side direction and the supply capability of the pre-charge voltage at the center portion in the long side direction in the display driver 100 can be more accurately reduced. In other words, as illustrated in FIG. 3, although the supply capability of the pre-charge voltage gradually varies depending on the positions in the long side direction, the supply capability of the pre-charge voltage can be adjusted in accordance with the variation.

4. Third Embodiment

Figure 8:
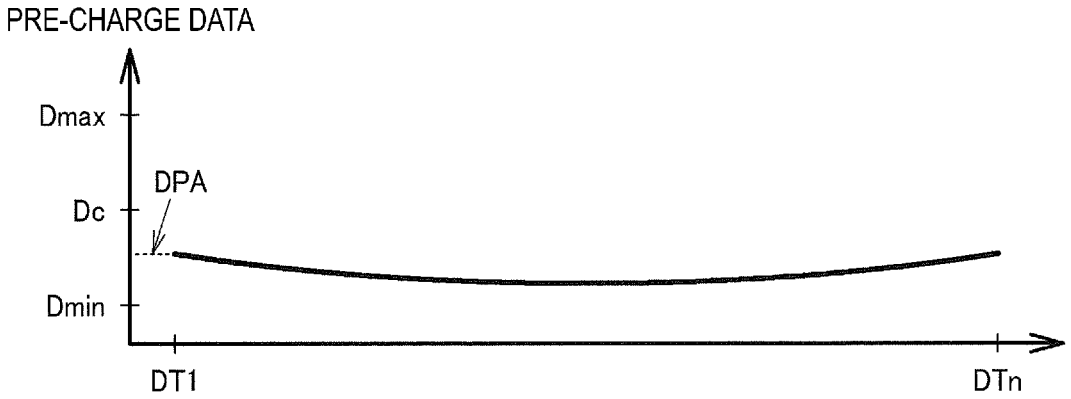
FIG. 8 is a diagram illustrating a pre-charge technique according to a third embodiment.
Figure 8:
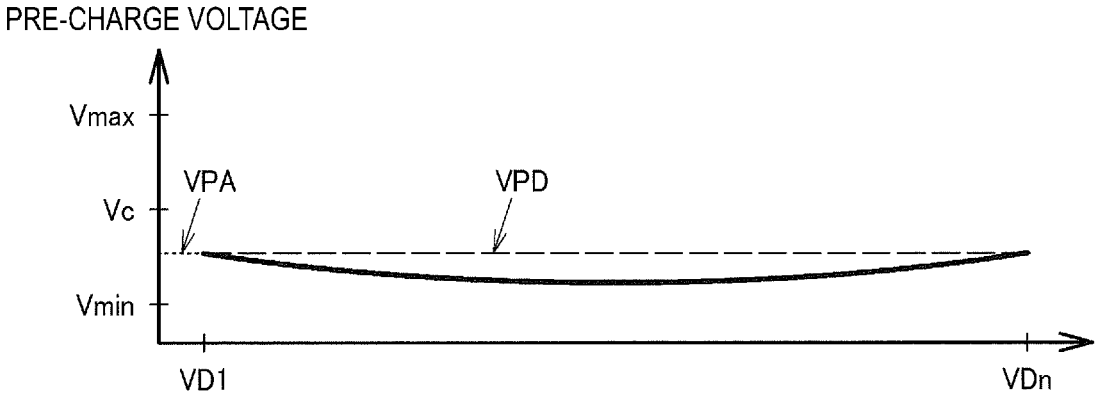

FIG. 8 is a diagram illustrating a pre-charge technique according to a third embodiment.

In the third embodiment, the processing circuit 10 generates the pre-charge data on the basis of the display data of the immediately preceding line and outputs the pre-charge data as the data DT1 to DTn. Taking FIG. 2 as an example, the processing circuit 10 determines the pre-charge data in the pre-charge period TPR2 of the horizontal scanning period THS2 on the basis of the display data DAa to DAd of the immediately preceding horizontal scanning period THS1. At this time, the pre-charge data is determined based on at least one of the display data DAa to DAd. For example, the pre-charge data is determined based on the maximum value, average value, median value, and the like of the display data DAa to DAd.

As a result of the output of the above-described pre-charge data, the pre-charge voltage based on the data voltage of the immediately preceding line is output as the voltages VD1 to VDn. FIG. 8 illustrates a case where the data voltages in the immediately preceding line are identical for all pixels in one line. In this case, the pre-charge voltage is lower in the center portion than in the end portion in the long side direction of the display driver 100. The pre-charge voltage indicated by the solid line in FIG. 8 has an ideal value. In other words, the pre-charge voltage actually supplied to the data line is higher than the ideal value in the center portion in the long side direction, and as such is represented as the VPD indicated by the long-dotted line in FIG. 8. As a result, a voltage close to the VPA is output as the voltages VD1 to VDn. Since the VPA is supplied to the data line at the end portion in the long side direction, the difference in the pre-charge voltage between the end portion and the center portion in the long side direction becomes small.

Figure 9:
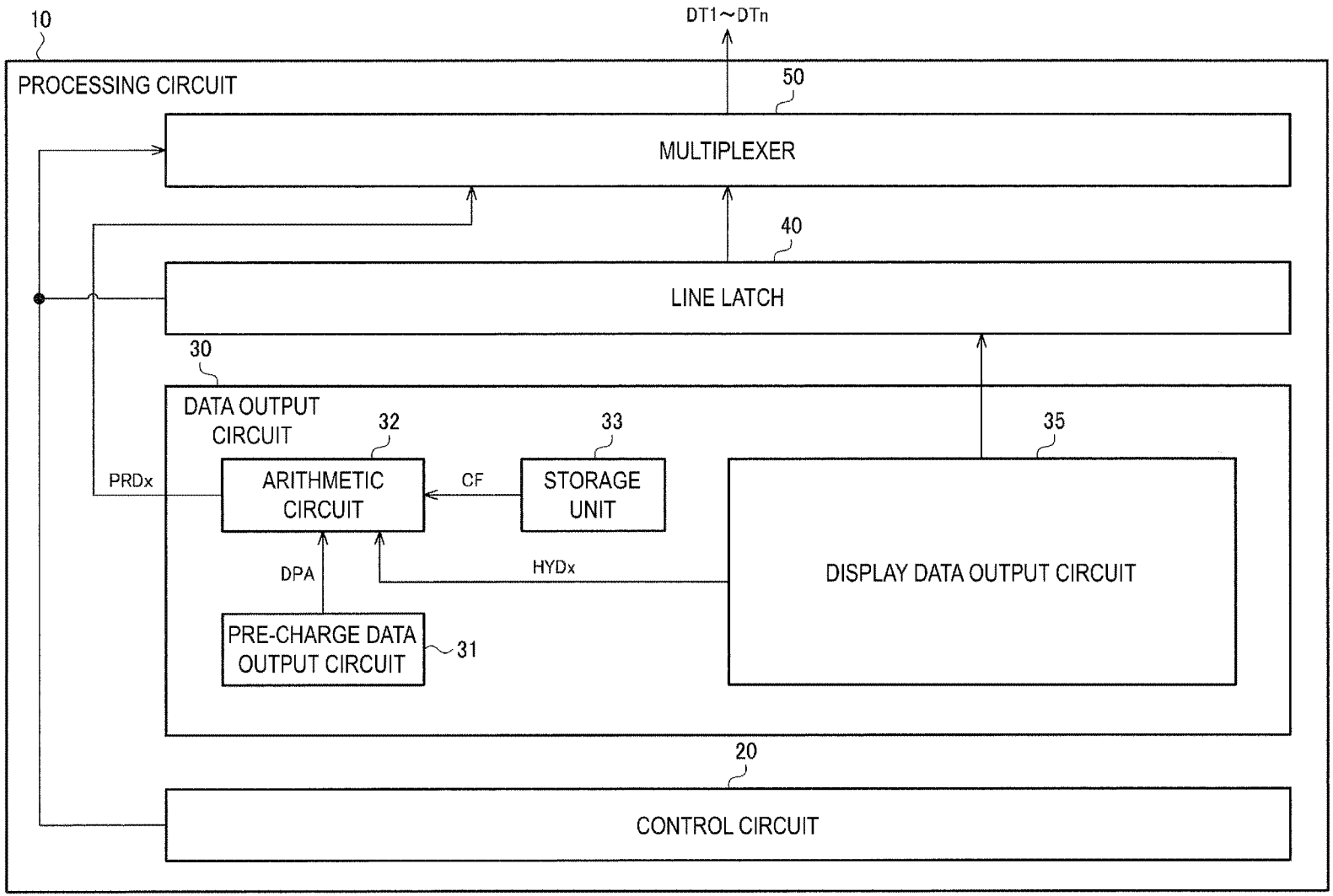
FIG. 9 illustrates a third exemplary detailed configuration of the arithmetic circuit.

FIG. 9 illustrates a third exemplary detailed configuration of the processing circuit 10. The processing circuit 10 includes the control circuit 20, the data output circuit 30, the line latch 40, and a multiplexer 50. The data output circuit 30 includes the pre-charge data output circuit 31, the arithmetic circuit 32, a storage unit 33, and the display data output circuit 35. Note that the components identical to the components that are described above with reference to FIGS. 5 and 7 are denoted with the same reference numerals, and description of the components will be appropriately omitted.

The storage unit 33 stores a correction coefficient CF that is used for computation of pre-charge data. The correction coefficient CF is a coefficient indicating a degree of correction for a pre-charge voltage. Specifically, the correction coefficient in the center portion in the long side direction is larger than the correction coefficient in the end portion in the long side direction. The correction coefficient CF may be stored in advance in the storage unit 33. Alternatively, an external processing device may write the correction coefficient CF into the storage unit 33 via an interface circuit not illustrated.

The arithmetic circuit 32 determines pre-charge data PRDx on the basis of the pre-charge data DPA from the pre-charge data output circuit 31, the correction coefficient CF from the storage unit 33, and display data HYDx from the display data output circuit 35. The x represents an integer of 1 or greater and n or smaller. When the correction coefficient CF differs depending on the position in the long side direction, it is represented as CFx. Specifically, the arithmetic circuit 32 determines the pre-charge data PRDx by PRDx=DPA−(HYDx×CF). HYDx×CF corresponds to a correction value (x). Note that, as described later in FIG. 11, determination of threshold or multiplication of the coefficient may be added in the computation of the pre-charge data. The arithmetic circuit 32 determines the pre-charge data in the horizontal scanning period of the immediately preceding line the line where pre-charging is to be performed. Taking FIG. 2 as an example, the arithmetic circuit 32 determines, in the horizontal scanning period THS1, the pre-charge data of the pre-charge period TPR2 of the next horizontal scanning period THS2. The arithmetic circuit 32 outputs the pre-charge data PRDx to the multiplexer 50. The multiplexer 50 outputs the pre-charge data PRDx as data DTx in the pre-charge period.

Figure 10:
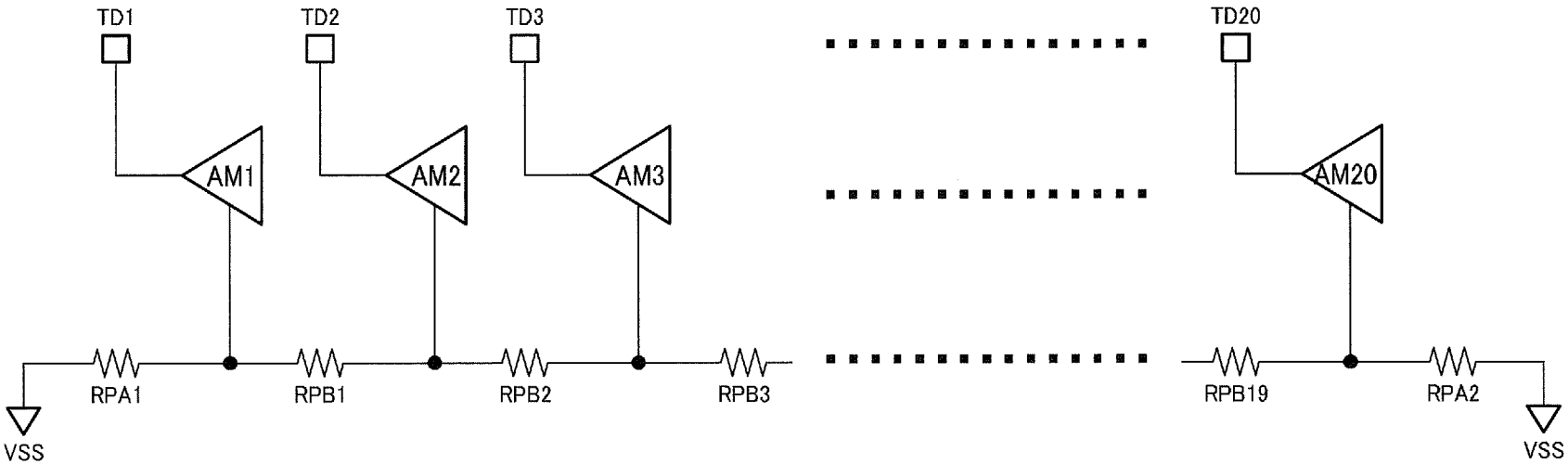
FIG. 10 illustrates exemplary computation of pre-charge data.

FIG. 10 and FIG. 11 illustrate exemplary computations of pre-charge data. Here, n=20 is described as an example.

FIG. 10 illustrates a model of a parasitic resistance used in the computation. Power source lines that supply a low potential side power VSS to amplifier circuits AM1 to AM20 are laid along the long side direction of the display driver 100. RPA1 and RPA2 and RPB1 to RPB19 are parasitic resistances of the power source lines. Here, as an example, RPA1=RPA2=7Ω and RPB1=RPB2= . . . =RPB19=1Ω are used.

FIG. 11 illustrates an exemplary computation using the model of FIG. 10. It is assumed that the display data of the immediately preceding line is "5" in common with each another for all pixels. The offset is an arbitrary fixed value. The offset may be different between a positive polarity driving period in which the pixels are positively driven and a negative polarity driving period in which the pixels are negatively driven. The correction coefficient is the combined resistance of the power source lines from the low potential side power VSS at both ends to each amplifier circuit. For example, the amplifier circuit AM1 has (7 Ω×26Ω))/(7Ω+26Ω))=5.5 ω. The error estimation value is (display data of immediately preceding line+offset)×correction coefficient. The threshold value of the error estimation value is 60, for example. When the error estimation value is smaller than the threshold value, the capability correction value is 0. When the error estimation value is equal to or greater than the threshold value, the capability correction value is "error estimation value−threshold value". The arithmetic circuit 32 determines the pre-charge data by "DPA−(capability correction value×coefficient). Here, the coefficient is any real number that does not depend on x.

According to the present embodiment, the processing circuit 10 generates pre-charge data of the pre-charge period on the basis of display data of the line immediately preceding the line driven in the horizontal scanning period including the pre-charge period.

In the pre-charge period, the amplifier circuits AM1 to AMn need to drive the data line from the data voltage written to the data line in the immediately preceding line to the pre-charge voltage. As such, the supplying capability of the pre-charge voltage depends on the data voltage written to the data line in the immediately preceding line. According to the present embodiment, since the pre-charge data is generated based on the display data of the immediately preceding line, the supply capability of the pre-charge voltage can be adjusted in accordance with the data voltage written to the data line in the immediately preceding line.

In the present embodiment, the storage unit 33 stores the correction coefficient. The arithmetic circuit 32 computes the pre-charge data on the basis of the correction coefficient and the display data of the immediately preceding line.

In this manner, the pre-charge data can be generated based on the display data of the immediately preceding line. In addition, by using the correction coefficient, the correction value can be determined from the display data of the immediately preceding line, and the pre-charge data can be corrected by the correction value. For example, by changing the correction coefficient in accordance with the position in the long side direction in the display driver 100, the pre-charge data can be corrected in accordance with the position in the long side direction in the display driver 100.

In addition, in the present embodiment, the arithmetic circuit 32 computes the pre-charge data of the pre-charge period in the horizontal scanning period immediately preceding the horizontal scanning period including the pre-charge period.

In other words, on the basis of the display data output in the horizontal scanning period, the arithmetic circuit 32 computes the pre-charge data to be used in the pre-charge period in the next horizontal scanning period. In this manner, it is not necessary to store the display data of the immediately preceding line, and thus the circuit size can be saved.

5. Fourth Embodiment

Figure 12:
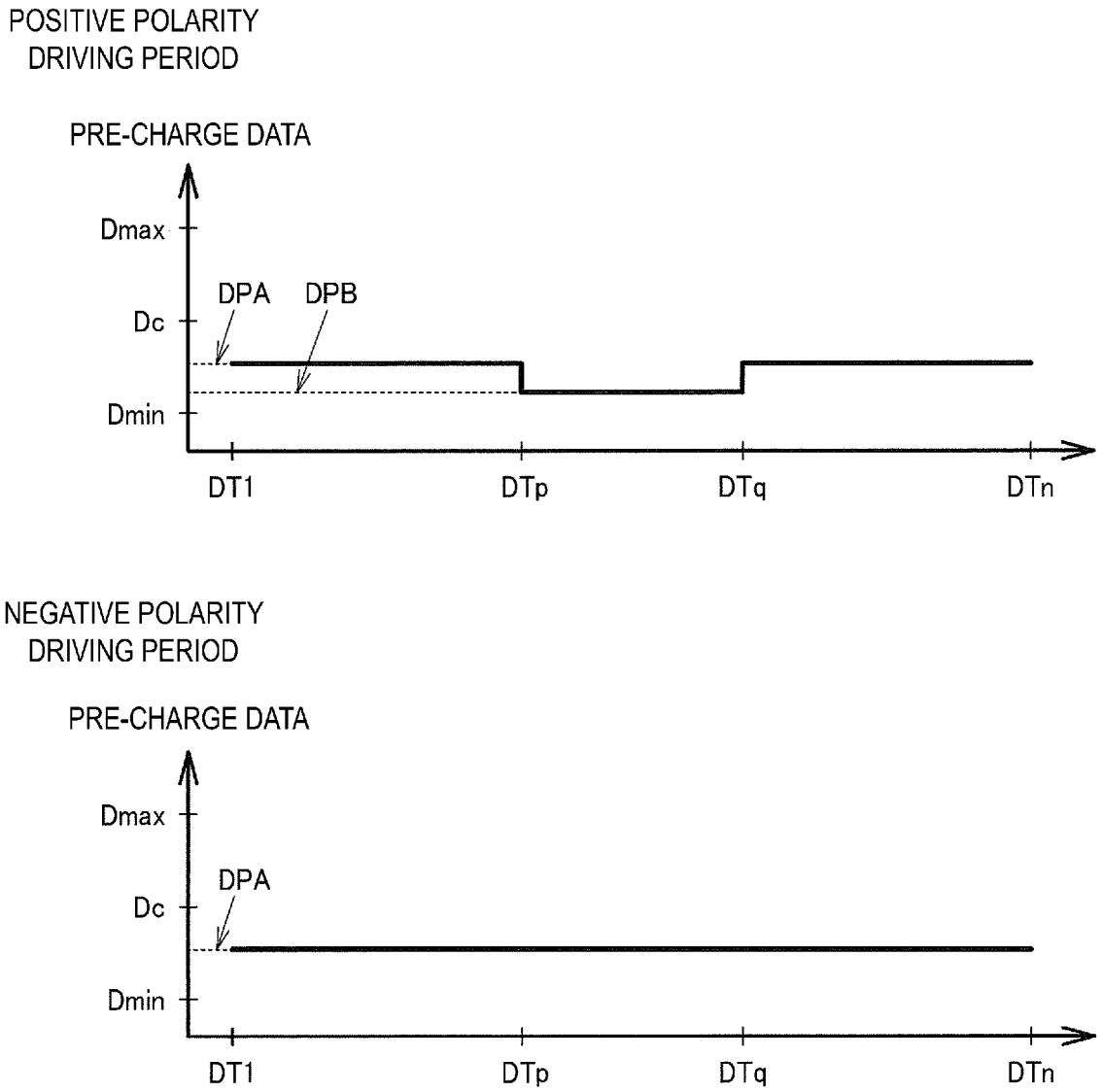
FIG. 12 is a diagram illustrating a pre-charge technique according to a fourth embodiment.

FIG. 12 is a diagram illustrating a pre-charge technique according to a fourth embodiment. In the fourth embodiment, the processing circuit 10 outputs pre-charge data identical to that of the first embodiment in the pre-charge period of the positive polarity driving period as the data DT1 to DTn, and outputs common pre-charge data as the data DT1 to DTn in the pre-charge period of the negative polarity driving period. The positive polarity driving period is a horizontal scanning period in which the pixels are driven with a positive data voltage. The negative polarity driving period is a horizontal scanning period in which the pixels are driven with a negative data voltage. The common pre-charge data is, for example, pre-charge data DPA at the end portion in the positive polarity driving period. Note that the common pre-charge data is not limited thereto, and may be any negative polarity data.

Note that the processing circuit 10 may output the pre-charge data identical to that of the second embodiment or the third embodiment as data DT1 to DTn in the pre-charge period of the positive polarity driving period, and may output the common pre-charge data as the data DT1 to DTn in the pre-charge period of the negative polarity driving period.

According to the present embodiment, the processing circuit 10 outputs the first pre-charge data to the D/A conversion circuit DACi and the second pre-charge data to the D/A conversion circuit DACj in the pre-charge period of the positive-polarity driving period. The processing circuit 10 outputs the common pre-charge data to the D/A conversion circuit DACi and the D/A conversion circuit DACj in the pre-charge period of the negative polarity driving period. $1 \le i \le p-1$ or $q+1 \le i \le n$ and $p \le j \le q$ hold. In FIG. 12, the first pre-charge data is DPA and the second pre-charge data is DPB.

As described in the third embodiment, the supply capability of the pre-charge voltage depends on the data voltage written to the data line in the immediately preceding line. As such, the supply capability of the pre-charge voltage differs between the positive polarity driving period and the negative polarity driving period. According to the present embodiment, the pre-charge data differing between the positive polarity driving period and the negative polarity driving period is output, and thus the supply capability of the pre-charge voltage can be adjusted in accordance with whether the period is the positive-polarity driving period or the negative polarity driving period.

For example, in the case of frame inversion driving, all horizontal scanning periods are the positive polarity driving period in the positive polarity driving frame, and accordingly, the data voltage written to the data line in the immediately preceding line is also positive. In this case, the amplifier circuit needs to perform the driving from the positive data voltage to the negative pre-charge voltage. As such, the supply capability of the pre-charge voltage is adjusted by lowering the pre-charge voltage at the center portion in the long side direction. On the other hand, in the negative polarity driving frame, the data voltage written to the data line in the immediately preceding line is negative. Since the amplifier circuit need only perform the driving from the negative data voltage to the negative pre-charge voltage, the driving load is small. Accordingly, the pre-charge voltage common to the end portion and the center portion in the long side direction is used. As a result, overcorrection of the pre-charge voltage can be prevented.

6. Electro-Optical Device and Electronic Apparatus

Figure 13:
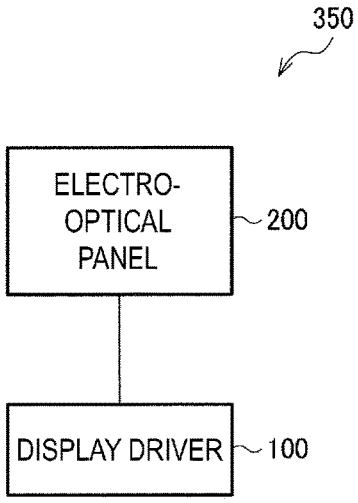
FIG. 13 is an exemplary configuration of an electro-optical device.

FIG. 13 illustrates an exemplary configuration of an electro-optical device 350 including the display driver 100. The electro-optical device 350 includes the display driver 100 and an electro-optical panel 200.

The electro-optical panel 200 is a liquid crystal display panel of an active matrix type, for example. For example, the display driver 100 is mounted on a flexible substrate and the flexible substrate is coupled to the electro-optical panel 200 such that image-signal output terminals of the display driver 100 and image-signal input terminals of the electro-optical panel 200 are coupled via wiring lines formed on the flexible substrate. Alternatively, the display driver 100 may be mounted on a rigid substrate and the rigid substrate and the electro-optical panel 200 may be coupled via the flexible substrate such that the image-signal output terminals of the display driver 100 and the image-signal input terminals of the electro-optical panel 200 are coupled via wiring lines formed on the rigid substrate and the flexible substrate.

Figure 14:
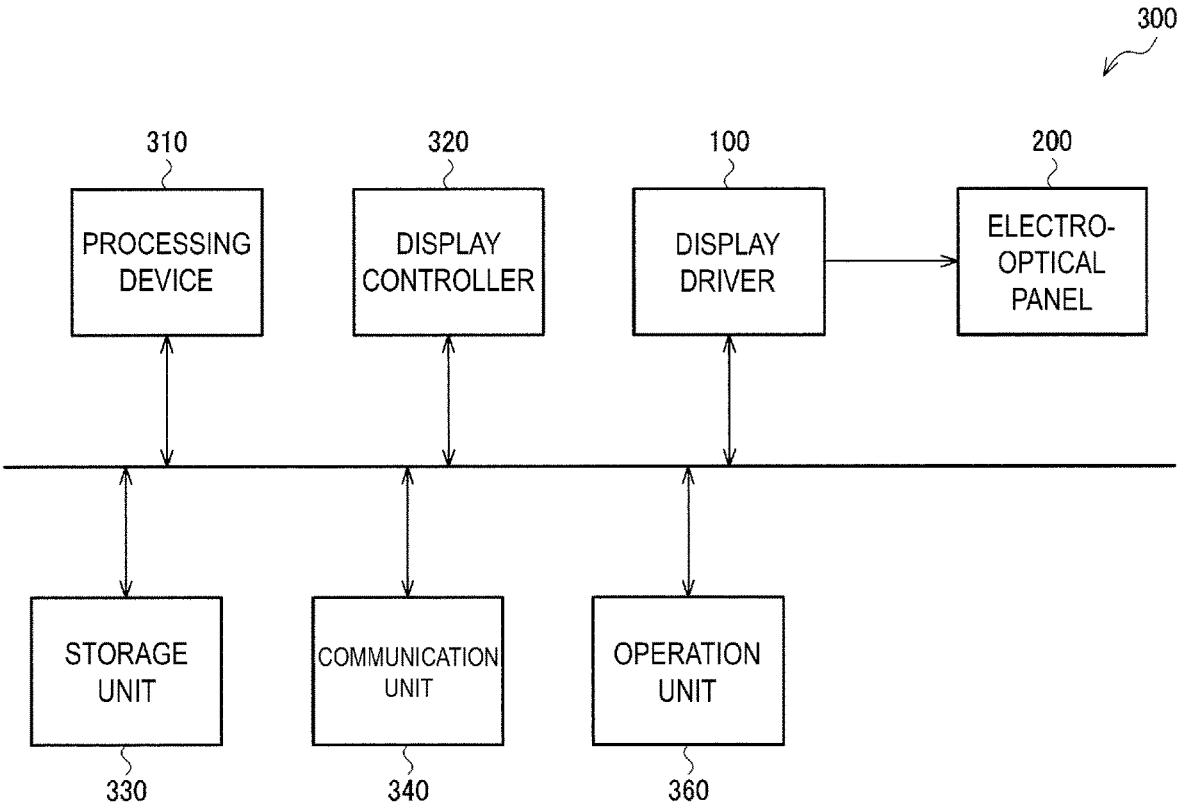
FIG. 14 is an exemplary configuration of an electronic apparatus.

FIG. 14 illustrates an exemplary configuration of an electronic apparatus 300 including the display driver 100. The electronic apparatus 300 includes a processing device 310, a display controller 320, the display driver 100, the electro-optical panel 200, a storage unit 330, a communication unit 340, and an operation unit 360. The storage unit 330 is also called a storage device or memory. The communication unit 340 is also called a communication circuit or a communication device. The operation unit 360 is also called an operation device. Specific examples of the electronic apparatus 300 may include various electronic apparatuses provided with display devices, such as a projector, a head-mounted display, a mobile information terminal, a vehicle-mounted device, a portable game terminal, and an information processing device. The vehicle-mounted device is, for example, a meter panel, a car navigation system, or the like.

The operating unit 360 is a user interface that receives various operations performed by a user. For example, the operating unit 360 is a button, a mouse, a keyboard, and/or a touch panel mounted on the electro-optical panel 200. The communication unit 340 is a data interface used for inputting and outputting image data and control data. Examples of the communication unit 340 include a wireless communication interface, such as a wireless LAN interface or a near field communication interface, and a wired communication interface, such as wired LAN interface or a USB interface. The storage unit 330, for example, stores data input from the communication unit 340 or functions as a working memory for the processing device 310. The storage unit 330 is, for example, a memory, such as a RAM or a ROM, a magnetic storage device, such as an HDD, or an optical storage device, such as a CD drive or a DVD drive. The display controller 320 processes image data input from the communication unit 340 or stored in the storage unit 330, and transfers the processed image data to the display driver 100. The display driver 100 displays an image on the electro-optical panel 200 on the basis of the image data transferred from the display controller 320. The processing device 310 carries out control processing for the electronic device 300 and various types of signal processing. The processing device 310 is, for example, a processor, such as a CPU or an MPU, or an ASIC.

For example, in the case where the electronic apparatus 300 is a projector, the electronic apparatus 300 further includes a light source and an optical system. The optical system is, for example, a lens, a prism, a mirror, or the like. In the case where the electro-optical panel 200 is of a transmissive type, the optical device emits light from the light source to the electro-optical panel 200, and the light transmitted through the electro-optical panel 200 is projected on a screen. In the case where the electro-optical panel 200 is of a reflective type, the optical device emits light from the light source to the electro-optical panel 200, and the light reflected at the electro-optical panel 200 is projected on a screen.

According to the embodiment, the display driver includes a processing circuit, first to nth D/A conversion circuits, first to nth data voltage output terminals (n is an integer of 3 or greater), and first to nth amplifier circuits. The processing circuit outputs display data. The first to nth D/A conversion circuits D/A-converts display data output from the processing circuit and outputs a D/A conversion result. The first to nth amplifier circuits output first to nth data voltages to the first to nth data voltage output terminals on the basis of D/A conversion results output from the first to nth D/A conversion circuits.

In the pre-charge period, the processing circuit outputs pre-charge data, the first to nth D/A conversion circuits D/A-converts the pre-charge data, and the first to nth amplifier circuits output a pre-charge voltage on the basis of the output voltage of the first to nth D/A conversion circuits. At this time, the processing circuit outputs first pre-charge data as the pre-charge data for an ith D/A conversion circuit (i is an integer of 1 or greater and n or smaller) in the pre-charge period, and outputs second pre-charge data different from the first pre-charge data as the pre-charge data for a jth D/A conversion circuit (j is an integer that satisfies $j \neq i$ and is 1 or greater and n or smaller).

In this manner, the difference between the supply capability of the pre-charge voltage at the end portion in the long side direction and the supply capability of the pre-charge voltage at the center portion in the long side direction of the display driver can be reduced. In other words, it is possible to reduce the difference in the pre-charge voltage actually supplied to the data line between the end portion and the center in the long side direction of the display driver.

In addition, in the present embodiment, the first to nth data voltage output terminals may be arranged along the long side direction of the display driver. In the case where the p and q are set to integers from 2 to n−1, $1 \leq i \leq p-1$ or $q+1 \leq i \leq n$, and $p \leq j \leq q$ may hold.

In this manner, in the long side direction of the display driver, the jth data voltage output terminal is positioned closer to the center than the ith data voltage output terminal. In this case, when the processing circuit outputs the first pre-charge data to the ith D/A conversion circuit and the second pre-charge data to the jth D/A conversion circuit, it is possible to reduce the difference between the supply capability of the pre-charge voltage at the end portion in the long side direction and the supply capability of the pre-charge voltage at the center portion in the long side direction of the display driver.

In addition, in the present embodiment, the first pre-charge voltage corresponding to the first pre-charge data and the second pre-charge voltage corresponding to the second pre-charge data may be pre-charge voltages that are negative with respect to the common voltage. The second pre-charge voltage may be lower than the first pre-charge voltage.

In this manner, the second pre-charge voltage at the center portion in the long side direction can be lower than the first pre-charge voltage at the end portion, and it is thus possible to reduce the pre-charge voltage actually supplied to the data lines in the center portion in the long side direction. As a result, the difference in the pre-charge voltage actually supplied to the data lines between the end portion and the center portion in the long side direction is reduced.

In the present embodiment, the processing circuit may output third pre-charge data different from the first pre-charge data and the second pre-charge data as pre-charge data for a kth D/A conversion circuit (k is an integer of 1 or greater and n or smaller) in the pre-charge period. In the case where the s and t are set to integers of p+1 or greater and q−1 or smaller, ps−1 or $t+1 \leq j \leq q$, and $s \leq k \leq t$ may hold.

In this manner, the difference between the supply capability of the pre-charge voltage at the end portion in the long side direction, the supply capability of the pre-charge voltage at a portion between the end portion and the center portion in the long side direction, and the supply capability of the pre-charge voltage at the center portion in the long side direction of the display driver can be reduced. In other words, although the supply capability of the pre-charge voltage gradually varies depending on the positions in the long side direction, the supply capability of the pre-charge voltage can be adjusted in accordance with the variation.

In the present embodiment, the processing circuit may output the first pre-charge data to the ith D/A conversion circuit and the second pre-charge data to the jth D/A conversion circuit in the pre-charge period of the positive polarity driving period. The processing circuit may output common pre-charge data as the pre-charge data to the ith D/A conversion circuit and the jth D/A conversion circuit in the pre-charge period of the negative polarity driving period.

The supply capability of the pre-charge voltage depends on the data voltage written to the data line in the immediately preceding line. As such, the supply capability of the pre-charge voltage differs between the positive polarity driving period and the negative polarity driving period. According to the present embodiment, the pre-charge data differing between the positive polarity driving period and the negative polarity driving period is output, and thus the supply capability of the pre-charge voltage can be adjusted in accordance with whether the period is the positive-polarity driving period or the negative polarity driving period.

Further, in the present embodiment, the processing circuit may generate the pre-charge data of the pre-charge period on the basis of the display data of the line immediately preceding the line that is driven in the horizontal scanning period including the pre-charge period.

In this manner, the pre-charge data is generated based on the display data of the immediately preceding line, and it is thus possible to adjust the supply capability of the pre-charge voltage in accordance with the data voltage written to the data line in the immediately preceding line.

In addition, in the present embodiment, the display driver may include a storage unit configured to store a correction coefficient. The processing circuit may include an arithmetic circuit, and the arithmetic circuit may compute the pre-charge data on the basis of the correction coefficient and the display data of the immediately preceding line.

In this manner, the pre-charge data can be generated based on the display data of the immediately preceding line. In addition, by using the correction coefficient, the correction value can be determined from the display data of the immediately preceding line, and the pre-charge data can be corrected by the correction value.

In the present embodiment, the arithmetic circuit may calculate the pre-charge data of the pre-charge period in the horizontal scanning period immediately preceding the horizontal scanning period including the pre-charge period.

In this manner, on the basis of the display data output in the horizontal scanning period, the arithmetic circuit can compute the pre-charge data to be used in the pre-charge period of the next horizontal scanning period. In this manner, it is not necessary to store the display data of the immediately preceding line, and thus the circuit size can be saved.

In the present embodiment, the electro-optical device includes the electro-optical panel and the display driver described above. The display driver drives the electro-optical panel.

Further, in the embodiment, the electronic apparatus includes the above-described display driver.

Although the embodiment has been described in detail above, those skilled in the art will easily understand that many modified examples can be made without substantially departing from the novel matters and effects of the present disclosure. All such modified examples are thus included in the scope of the present disclosure. For example, terms in the descriptions or drawings given even once along with different terms having identical or broader meanings can be replaced with those different terms in all parts of the descriptions or drawings. All combinations of the embodiment and modified examples are also included within the scope of the present disclosure. The configurations, operations, and the like of the display driver, the electro-optical panel, the electro-optical device, and the electronic apparatus are not limited to those described in the embodiments, and various modifications may be made.

What is claimed is:

1. A display driver comprising:

a processing circuit configured to output display data;

first to nth D/A conversion circuits configured to D/A-convert the display data output from the processing circuit, and to output a D/A conversion result, n being an integer of 3 or greater;

first to nth data voltage output terminals; and first to nth amplifier circuits configured to output first to nth data voltages to the first to nth data voltage output terminals based on the D/A conversion result output from the first to nth D/A conversion circuits, wherein in a pre-charge period, the processing circuit outputs pre-charge data, the first to nth D/A conversion circuits D/A-convert the pre-charge data, and the first to nth amplifier circuits output a pre-charge voltage based on an output voltage of the first to nth D/A conversion circuits, the processing circuit, in the pre-charge period, outputs first pre-charge data as the pre-charge data for an ith D/A conversion circuit, and outputs second pre-charge data as the pre-charge data for a jth D/A conversion circuit, the second pre-charge data being different from the first pre-charge data, i being an integer from 1 to n, j being an integer from 1 to n, and not equal to i, a first pre-charge voltage corresponding to the first pre-charge data and a second pre-charge voltage corresponding to the second pre-charge voltage are negative with respect to a common voltage, and the second pre-charge voltage is lower than the first pre-charge voltage.

2. The display driver according to claim 1, wherein the first to nth data voltage output terminals are arranged along a long side direction of the display driver; and $1 \leq i \leq p-1$ or $q+1 \leq i \leq n$, and $p \leq j \leq q$, wherein p and q are integers from 2 to n−1.

3. The display driver according to claim 1, wherein the processing circuit outputs third pre-charge data as the pre-charge data for a kth D/A conversion circuit in the pre-charge period, the third pre-charge data being different from the first pre-charge data and the second pre-charge data, wherein k is an integer from 1 to n; and $p \leq j \leq s-1$ or $t+1 \leq j \leq q$ and $s \leq k \leq t$, wherein s and t are integers from p+1 to q−1.

4. The display driver according to claim 1, wherein the processing circuit outputs the first pre-charge data to the ith D/A conversion circuit and outputs the second pre-charge data to the jth D/A conversion circuit in the pre-charge period of a positive-polarity driving period; and the processing circuit outputs common pre-charge data, as the pre-charge data, to the ith D/A conversion circuit and the jth D/A conversion circuit in the pre-charge period of a negative polarity driving period.

5. The display driver according to claim 1, wherein the processing circuit generates the pre-charge data of the pre-charge period based on display data of an immediately preceding line immediately preceding a line that is driven in a horizontal scanning period including the pre-charge period.

6. The display driver according to claim 5, comprising a storage unit configured to store a correction coefficient, wherein the processing circuit includes an arithmetic circuit configured to compute the pre-charge data based on the correction coefficient and the display data of the immediately preceding line.

7. The display driver according to claim 6, wherein the arithmetic circuit computes the pre-charge data of the pre-charge period in a horizontal scanning period immediately preceding the horizontal scanning period including the pre-charge period.

8. An electro-optical device comprising:

an electro-optical panel; and the display driver according to claim 1 configured to drive the electro-optical panel.

9. An electronic apparatus comprising the display driver according to claim 1.

* * * * *